United States Patent [19]

Richner

[11] 4,250,730

[45] Feb. 17, 1981

[54] DEVICE FOR THE EJECTION OF A SHAPED WORKPIECE AT THE MALE DIE ON A CROSS-FEED PRESS FOR NON-CUTTING METAL SHAPING

[75] Inventor: Hans Richner, Büsserach, Switzerland

[73] Assignee: Hatebur Umformmaschinen AG, Basel, Switzerland

[21] Appl. No.: 19,221

[22] Filed: Mar. 9, 1979

[51] Int. Cl.[3] ..... B21D 45/00

[52] U.S. Cl. ..... 72/344; 72/427

[58] Field of Search ..... 10/11 E; 72/427, 344, 72/345, 346

[56] References Cited

U.S. PATENT DOCUMENTS 3,820,376 6/1974 Koch ..... 10/11 E

FOREIGN PATENT DOCUMENTS 1224591 9/1966 Fed. Rep. of Germany ..... 72/345
1254437 11/1967 Fed. Rep. of Germany ..... 72/427
1627977 5/1978 Fed. Rep. of Germany ..... 72/427
523321 4/1954 France ..... 10/11 E
7303904 12/1973 Netherlands ..... 72/345

*Primary Examiner*—Leon Gilden
*Assistant Examiner*—Gene P. Crosby
*Attorney, Agent, or Firm*—Toren, McGeady and Stanger

[57] ABSTRACT

A device for the ejection of a shaped part at the male die on a cross-feed press for non-cutting metal shaping is equipped with an ejector which is controlled by the crank-pin of a crankshaft via a connecting link, a cam disc and a roller arm. The cam contour P of the cam disc has an arc K concentric to the rocker shaft and joined to a straight section G and a runout section L. The cam disc has a displaceable cam shoe the outer edge of which is located in the plane of the straight section G and which extends or shortens the straight section G when shifted. This ensures that the standstill condition of the ejector with respect to the female die, required for holding the shaped part, may be retained even when adjustments are made to the length of the stroke of the ejector at the male die at the cam disc.

8 Claims, 18 Drawing Figures

Figure 3A:
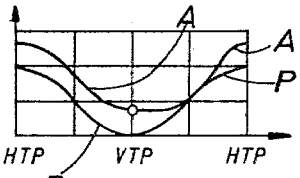
Figure 3B:
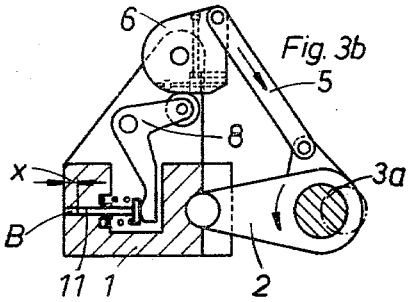

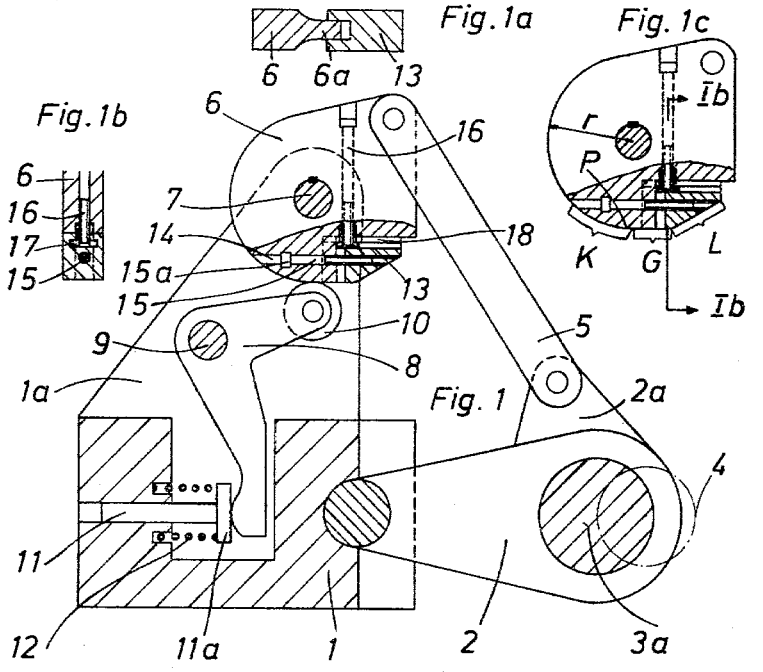
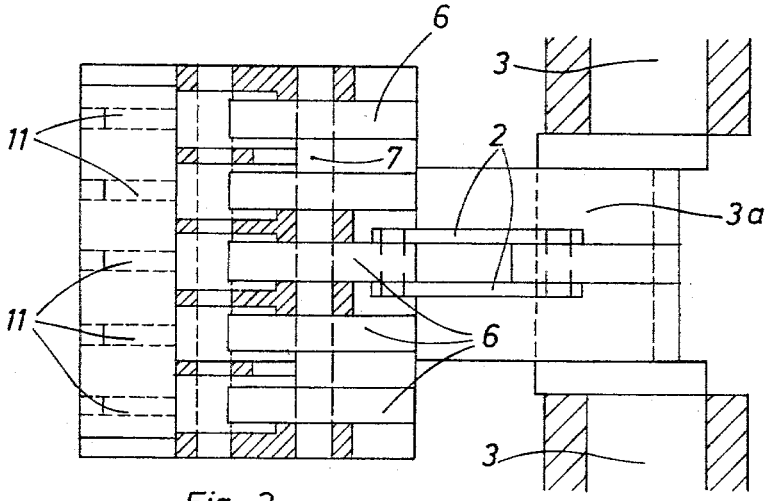
Fig. 2

DEVICE FOR THE EJECTION OF A SHAPED WORKPIECE AT THE MALE DIE ON A CROSS-FEED PRESS FOR NON-CUTTING METAL SHAPING

DESCRIPTION

German Patent specification No. 1,254,437 discloses a device for controlling the movement of auxiliary elements, such as press slide ejectors, the time interval and movement characteristic of which can be selected by adjusting the device. According to this German Patent it has been suggested, in contrast to the arrangement of a locally fixed cam shoe known already for some time, to transfer a movement derived from the crankshaft via a hinge mechanism to a cam which drives the ejector via a bell crank.

There are numerous cases of the application of ejector devices in which it is desirable that the formed part is held between the movable and the fixed die until it has been taken over by the transfer grippers. The ejector on the side of the movable die, therefore, must be stopped for a short period while the press slide is already retracting. This means however that the ejector which is supported in the movable die must have imparted to it, by a drive element (the bell crank) arranged on the returning press slide, a movement which on the one hand corresponds exactly to that of the press slide but on the other hand is opposed to it in direction so that the movement of the drive element just cancels that of the press slide and the ejector remains stationary.

Although such a type of movement may well be provided in the known device according to the said German Patent specification No. 1,254,437 by virtue of the shape of the oscillating disc (28), this would then only apply in one certain position of the disc. The straight line representing the stopped condition of the ejector in the position/time diagram is obtained only in the design position. With adjustment for different strokes, the position/time function deviates from the required straight line and becomes S-shaped. However, for the practical application of the device this is a grave disadvantage which badly restricts the possibilities of using the device.

It is the object of the present invention, therefore, to provide a device for the ejection of a shaped part at the movable die while allowing the standstill of the ejector at the movable die, as is necessary for holding the shaped part temporarily, to be retained unchanged even with adjustments of the stroke length at the control disc.

According to the present invention there is provided a device for the ejection of a shaped workpiece at the movable die on a cross-feed press for non-cutting metal shaping, comprising a reciprocating crank-driven press slide carrying at least one movable press die coaxially opposite a respective fixed die, the or each movable press die being associated with an ejector the movement of which is controlled via an oscillating cam disc driven in an oscillating motion and articulated to the connecting rod of the crankshaft by means of an actuating arm which actuates the ejector, wherein the cam contour of the cam disc has an arc concentric to the axis of pivoting of the cam disc, and a straight region following the said arc serially in direction of the ejection movement, the part of the cam disc at the circumference of which the said straight region is provided being releasably connected to the cam disc so that the straight region can be shortened or extended either by exchanging the said part or by adjusting it so that an intentional short-period standstill of the said ejector at the movable die, relative to the associated fixed die, is maintained independently of the length of the stroke of the movable die set at the cam disc.

Preferably, in the said straight region, at the circumference of the cam disc and on the side of the cam disc facing the said arm there is a cam shoe which can be displaced parallel to the said straight region and fixed in any position. More preferably the device is one wherein the cam shoe has a U-shaped cross-section and displaceably encompasses a tongue of the cam disc; wherein a spindle rotatably mounted in the cam disc and secured against axial displacement therein projects into a threaded drilling of the cam shoe; and wherein the cam shoe is able to be pressed against the cam disc by means of a fixing screw arranged in the cam disc and can thus be fixed in any desired position.

Advantageously each cam disc is subdivided into two sections releasably connected to each other, and a set of mutually interchangeable said cam disc parts of different shapes facing the said arm is provided in consideration of different lengths of stroke depending on the shape of the respective workpiece to be shaped.

Conveniently, within one set of the said interchangeable cam disc parts, after transition regions arranged beyond the ends of the rocking angle there are concentric arcs passing over into the said straight region in such a way that the straight regions are placed at different distances from a parallel line passing through the pivot axis of the said cam disc, said straight regions being stepped in such a way that they allow the forward end of the travel of the ejector to be kept independent of the choice of respective lower cam disc section, whereby the length of the respective straight region joining the said concentric arcs decreases with increasing distance of the said straight region from the said parallel line. Alternatively the said straight regions of all said interchangeable cam disc parts of a matching set have the same distance from a parallel line passing through the cam pivot axis and the straight regions of the individual said interchangeable cam disc parts are stepped in length in that they pass into a runout section at different points spaced apart from each other along said straight region.

Desirably said cam disc is rotatable relative to its shaft and is fixable thereon in different angular positions, so that the said arm rolls only on a said concentric arc, after the cam disc has been lined up correspondingly on its rocker shaft to leave the roller arm at a standstill.

In order that the present invention may more readily be understood the following description is given, merely by way of example, with reference to the accompanying drawings, in which:

FIG. 1 is a simplified sectioned view of a device for the ejection of a shaped part at the movable die, on a cross-feed press;

FIGS. 1*a*, 1*b* and 1*c* are sectional views showing design details of this device;

FIG. 2 is a partly sectioned top plan view of the device shown in FIG. 1;

FIGS. 3*a* to 6*a* are distance/time diagrams for the press slide and ejector, each successive Figure showing an instantaneous position displaced with respect to the preceding Figure by 90° of crank angle, FIGS. 3*b* to 6*b* show the device of FIG. 1 in its operating positions which correspond to the diagrams of FIGS. 3*a* to 6*a;*

Figure 7:
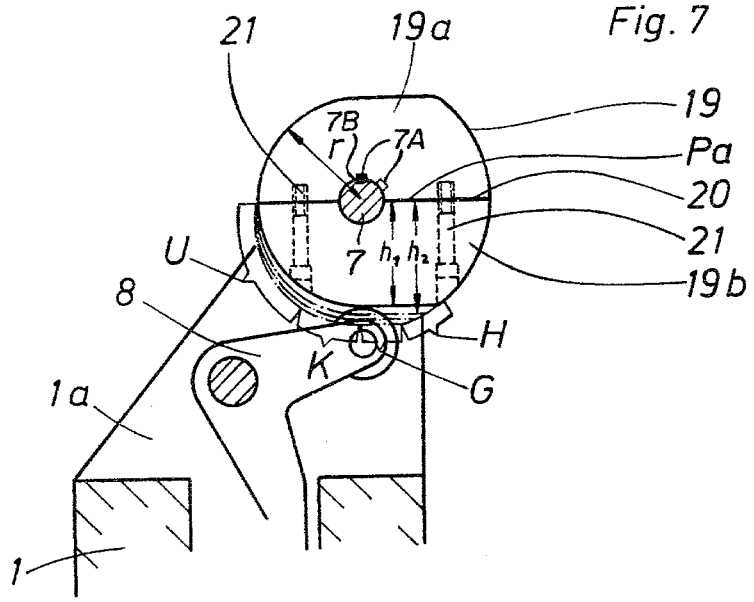
Figure 8:
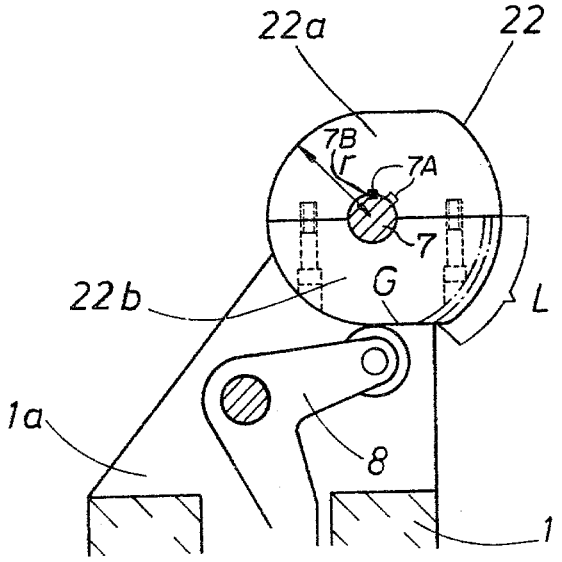
Figure 9:
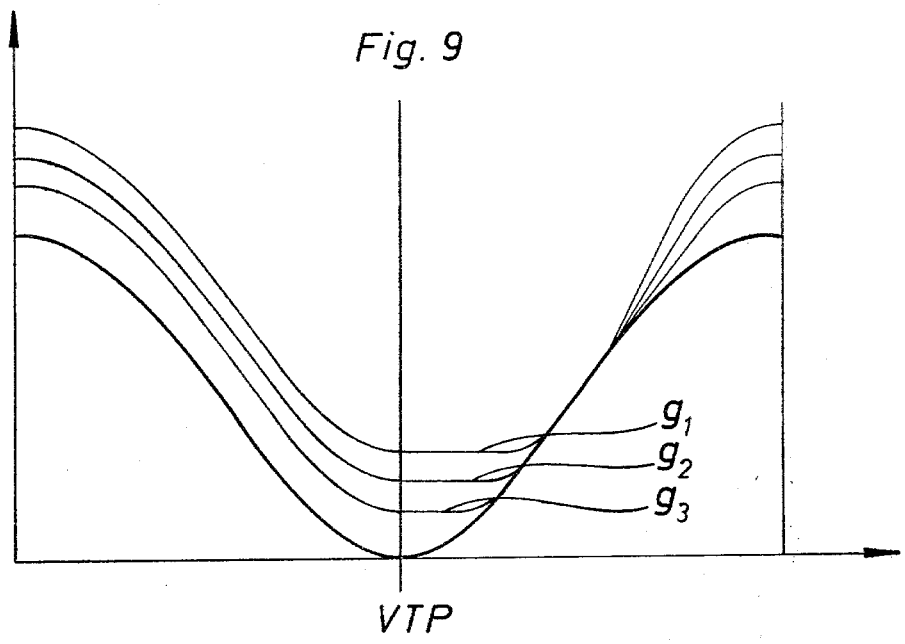
Figure 10:
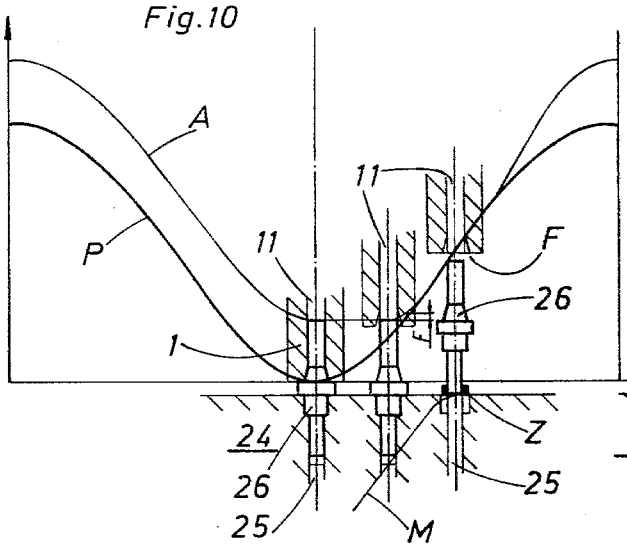
Figure 11:
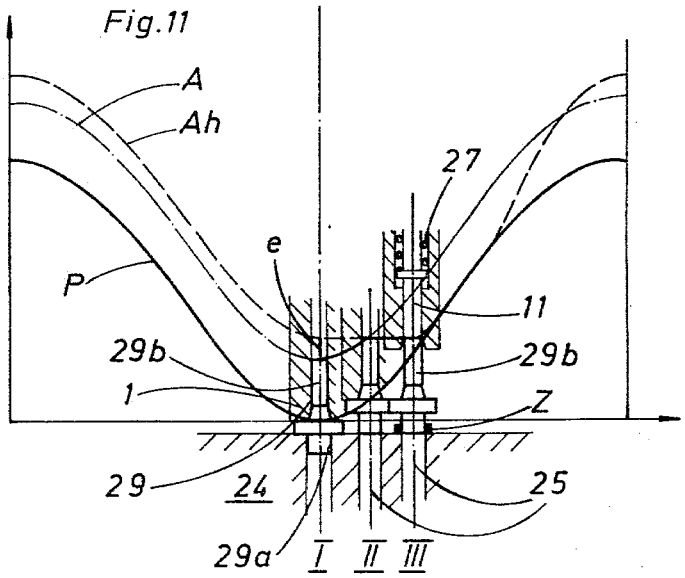

FIGS. 7 and 8 are sectioned representations of two design variants;

FIG. 9 illustrates the ejector movement with different lengths of stroke with the aid of a distance/time diagram; and FIGS. 10/10*a* and 11 show further variants of the device according to the invention, where FIGS. 10 and 11 both show the part of the press with the ejector in different operating positions and where the curves of the distance/time diagram corresponding to the movement of the press slide and the ejector.

FIG. 1 depicts a press slide 1 which is driven in periodic reciprocating movement by the crankpin 3*a* of a crankshaft 3 (FIG. 2) via a connecting rod 2. The crankpin circle 4 of the crankshaft represents the rotational movement of the crankpin 3*a*. A connecting link 5 provides an articulated connection between a bracket 2*a* carried by the connecting rod 2 and a cam disc 6. The cam disc 6, which is keyed on a rocker shaft 7, is driven by the connecting link 5 in a rocking motion due to the movement of the connecting rod 2 and thus performs a limited rocking motion around the axis of the rocker shaft 7 with each revolution of the crankshaft 3 (FIG. 2).

An upwardly extending part 1*a* of the press slide 1 supports a roller arm 8 for rotation around an axis 9. The upper arm of the roller arm 8 carries a freely rotatable roller 10 bearing on the circumference of the cam disc 6; the lower arm of the roller arm 8 bears against an ejector rod 11 which is displaceably supported in the press slide 1 and forms the transfer rod for the ejector pin (not shown) at the movable die. In the present Specification both the ejector pin and its transfer rod together will be called the ejector. A compression spring 12 secured between the body of the press slide and a spring plate 11*a* attached to the ejector 11 ensures that the roller 10 always rests against the circumference of the cam disc 6.

At its circumference, the cam disc has a contour P (FIG. 1*c*) on which the roller 10 travels during the rocking movement of the cam disc. This contour P is composed of a section K of radius r which is concentric to the rocker shaft 7, and a straight section G tangential to the section K. The straight section G is followed by a runout section L the inclination of which has been selected to be such that its distance from the rocker shaft 7, seen in the direction K-G-L, does not change materially. Thus the runout section L is designed in such a way that when the roller 10 rolls off on it the ejector 11 will come to a standstill, at least approximately, relative to the returning press slide. This is of particular significance if the roller 10 runs off on the runout section L when the length of stroke is at its shortest value.

The cam disc 6 carries at its lower part facing the roller arm 8 a cam shoe 13, which is supported to be displaceable parallel to the direction of the straight section G and has a lower limiting surface which is situated in the plane of the straight section G. This cam shoe 13 also forms the runout section L. To this end a partially threaded spindle 15 is supported inside a throughbore 14 such that, although it can be turned by means of its socket head 15*a*, it is not itself displaced axially during such rotation. For this purpose the spindle has a hexagonal socket head 15*a* supported rotatably in a widened part of the throughbore 14, access to this recess being made possible, for example, by a retaining ring (not shown). The threaded section of the spindle 15 projects into a threaded drilling inside the cam shoe 13 so that the cam shoe 13 is pulled toward the spindle head 15*a* or moved away from it, depending on the direction of rotation, when the spindle 15 is rotated. The axis of the throughbore 15 runs parallel to the straight section G; thus, by shifting the cam shoe 13 in the described manner, the straight section G of the cam contour can be extended or shortened.

As shown in FIG. 1*a*, the cam shoe 13 has a cross-section, in the form of a U with its two legs enclosing a projecting tongue 6*a* of the cam disc 6. The roller 10 is wide enough to cover the cam track on the cam shoe 13 and on cam disc 6.

The cam shoe 13 can be locked in a desired position, for example by means of a grub screw 16 the threaded part projecting into a T-shaped nut 17 (FIG. 1*b*) which is displaceably supported in a T-slot 18 recessed into the upper part of the cam shoe 13. If the fixing screw 16 is tightened, the nut 17 pulls the cam shoe 13 against the surface of the cam disc 6 above it and thus locks the cam shoe 13 in this position.

The partially sectioned top plan view of FIG. 2 shows that the press slide 1, driven by the connecting rod 2, comprises altogether five cam discs 6, corresponding to the number of intended shaping stations. These cam discs 6 act via the roller arms 8 on the same number of (i.e. six) ejector rods 11 carried by the respective male dies.

It will aid understanding of the FIGS. 3*a* to 6*a* and 3*b* to 6*b* to say beforehand that the movably supported ejector pin, not shown, which can be considered as the direct extension of the ejector transfer rod 11, initially follows the movable die along during the forward stroke of the male die attached to the press slide, until the workpiece to be shaped has been shaped at the forward dead centre (FDC) position of the movable die.

The press slide begins its return stroke immediately after shaping, and would thus withdraw the shaped part from the fixed die during this return stroke if the workpiece were not ejected from the movable die by the ejector carried thereby.

At the beginning of the return of the movable die, its ejector, although in absolute terms it is standing still, is thus performing a relative movement with respect to the returning press slide which corresponds exactly to the speed of movement of the press slide but is in the opposite direction, so that the shaped part is being held between the ejectors of the movable and fixed dies until it has been taken over by the cross-feed grippers for transport to the next shaping station.

Figure 4A:
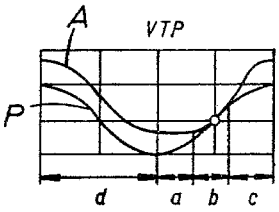
Figure 4B:
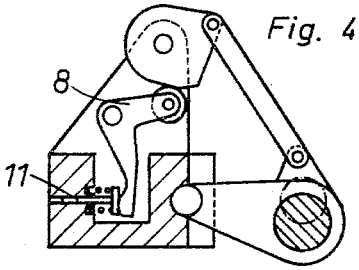

The distance/time (or stroke/crank angle) diagram in FIG. 3*a* shows the movement characteristic of the ejector 11 at the movable die as a curve E, and that of the press slide 1 as curve P. The associated position of the device, shown in the adjacent FIGS. 3*b* to 6*b*, in each case corresponds to that point on the curve which is framed by a small circle in FIGS. 3*a* to 6*a*. If the two curves E and P represent the respective front edges of the ejector 11 and the press slide 1, then initially the two curves E and P run parallel until the FDC position has been reached. In this position the front edge of the ejector 11 is still located behind the front edge of the press slide 1 by a distance x (FIG. 3*b*) since the shaped part protrudes both into the fixed die and into the drilling B in the movable die. However, once the FDC point has been passed, this situation changes and the ejector 11 is now ejected under the influence of the cam disc (withdrawing with the press slide) so that this cam movement just cancels out the return movement of the press slide. Seen in absolute terms, the ejector 11 has thus remained at its position reached in the FDC. From FIGS. 4*a* and 4*b*, showing the position 90° after FDC, the front edge of the ejector 11 is now flush with that of the press slide, and the shaped workpiece has been ejected from the movable die, but is still held between the ejector 11 and the ejector pin (not shown) of the female die.

Figure 5A:
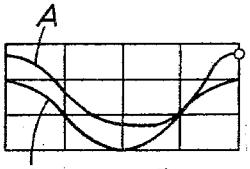
Figure 5B:
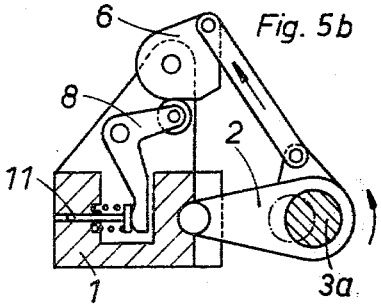
Figure 6A:
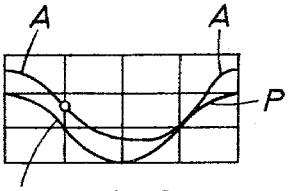
Figure 6B:
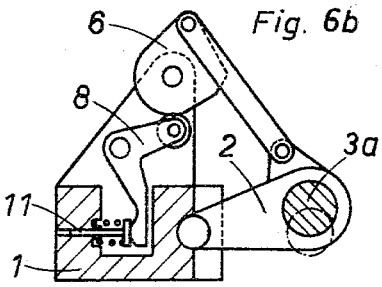

After a further 90° rotation of the crankshaft, the position shown in FIG. 5*a*/5*b* is reached. As shown in FIG. 5*a*, the ejector 11 has been controlled by the cam disc 6 in such a way that, after FDC, it:

initially showed absolute standstill in region a (FIG. 4*a*), where the front edges of ejector and press slide approach one another, subsequently a joint and partially parallel return movement with the press slide is performed in region b, following which the ejector 11 begins its return movement and has completed it at the rear dead centre (RDC) position (transition from FIG. 4*b* to FIG. 5*b*, at region c) and then the ejector and press slide are moved parallel to each other along region d up to the FDC position.

It has been mentioned already that the ejector 11 does not perform any absolute movement along region a; this section, therefore, is an exactly real straight line in the distance/time diagram since it would not be possible otherwise to hold the shaped workpiece. Within the context of the present invention it is now of special significance that, thanks to the special design of the cam disc 6, this straight line in the distance/time diagram remains intact also when the ejector stroke and the stopping time (length of straight section G of the cam contour) is altered in dependence on the shape of the workpiece to be shaped. Combining the concentric arc K (FIG. 1) with the adjustable length straight section G which runs into it, guarantees that no expensive manipulations are required at the ejector system of the movable die when changing over to other workpiece shapes. Simple rotation of the spindle 15 and operation of the fixing grub screw 16 allows continuous adjustment of the length of time for which the ejector 11 is to perform its holding function. FIG. 9 shows a few of the possible curves representing the movement of the ejector. In FIG. 9 the long straight section $g_1$ in the diagram corresponds to a long section G at the cam disc (FIG. 1), and the straight sections $g_2$ and $g_3$ represent two shorter lengths G (and with them the holding times) when the cam shoe 13 (FIG. 1) is repositioned leftwardly on the tongue 6*a* of the cam disc 6.

Provided the concentric arc K of the cam contour (FIG. 1) is long enough to extend at least over the amplitude of the angle through which the cam disc is rocked by the camshaft 2, the device described can also be changed over to idle operation quite easily; for this purpose the cam disc 6 is lined up on the rocker shaft 7 in such a way that the roller 10 of the roller arm runs along only on the concentric arc K. It is clear that for this the cam disc should be rotatable with respect to the rocker shaft 7 and that it should be possible to lock it in at least two different positions.

The device shown in FIG. 1 has a slight disadvantage, however, in that with a change-over to a shorter stroke for the ejector 11 the ejector no longer initially quite reaches its forward end position flush with the edge of the press slide even 90° after FDC (FIG. 4*b*). There is a known compensating device by means of which the missing dimension can be compensated for at the roller arm 8. A variant of the concept of the invention, no longer requiring such compensation with the selection of another ejector stroke, is shown in FIG. 7.

Here the cam disc, designated 19 in its entirety, is subdivided along a plane of division 20 into two sections 19*a* and 19*b* which are joined to each other by screws 21. The lower cam disc section 19*b* can be taken out easily by disengaging the drive link 5, tilting the rocker shaft 7 by about 180°, and then untightening the screws 21, and can thus be replaced quickly by another section with a different cam contour. Some alternative contours of such a set of lower cam disc sections 19*b*, to be held in store, are indicated in dot-dashed lines in FIG. 7. It can be seen that the different contour portions extend from about the left edge of the lower cam disc section 19*b* up to the point in the region H where the straight-line contour sections finish. A transition section U extends over into the concentric arc K following the straight region G. The straight regions G are themselves situated at different distances $h_1$, $h_2$ . . . from a parallel line Pa passing through the axis of the rocker shaft 7. The stroke of the ejector can thus be shortened by using a new lower cam disc section with a smaller straight-line contour section. In this arrangement the distances $h_1$, $h_2$ etc. (FIG. 7) are selected in such a way that they will compensate for the axial displacement of the ejector 11 resultant upon every change in stroke length. Thus the distances $h_1$, $h_2$ . . . of the straight-line contour regions from the parallel line Pa increase successively by a given amount depending on the intended change in stroke length and the leverage ratio of the roller arm 8. In this variant the ejector 11 retains the same forward end position no matter what the stroke setting.

Cam disc 19 can be rotated relative to its shaft 7 so that it can be fixed thereon in different angular positions by different keyway-key arrangements. Note in FIG. 7 and FIG. 8 two different keyway 7A positions are illustrated in which key 7B can be selectively positioned for changing the angular position of the cam disk 19 relative to the shaft 7.

The cam disc 22 in FIG. 8 has a contour the effect of which can be compared to that of FIG. 1. However, in contrast to the embodiment of FIG. 1 there is no adjustable cam shoe here but (as in FIG. 7) a complete set of lower cam disc sections 22*b* with stepped contour changes is held in store and the corresponding cam disc section is selected and used as required. In contrast to the embodiment of FIG. 7, the change in the cam contour is here applied only to the runout part L so that the individual cam disc sections of the same set differ only in the different length of the straightline contour parts. While thus corresponding in principle to the embodiment of FIG. 1, this variant has the disadvantage that it is not possible with this variant to vary the length of the ejector stroke continuously over a range of values.

The interplay of the ejectors at the movable and fixed dies, necessary with the ejection of a shaped workpiece, is illustrated with the aid of FIGS. 10 and 11 with two shaped workpieces of different lengths.

FIG. 10 shows a male die 1 mounted on a press slide and having an ejector 11 at the movable die and, coaxially opposed thereto, a fixed die 24 with its associated ejector 25. In the FDC position shaping has just been finished; the two ends of the shaped workpiece 26 protrude into the drillings of movable die 1 and fixed die 24 from which it has to be released now in such a way that it can be gripped securely by the cross-feed grippers.

The motion curves E, P and F in the distance/time diagram of the ejector, press slide and fixed die show that the ejector is standing still from the FDC position on, and is leaving the shaped workpiece in the fixed die while the movable die 1 is being retracted and is thus releasing the shaped workpiece. Now the shaped workpiece is being pushed out by the ejector 25 of the fixed die, eliminating the hold function on the side of the movable die since the two ejectors must always have some play with respect to the shaped workpiece (position f). In this embodiment the shaped workpiece must therefore be pushed from the fixed die 24 straight into the ready gripper Z, or an auxiliary device shown in FIG. 10*a* must be installed.

Figure 10A:
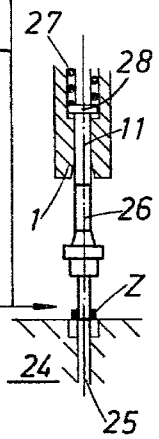

In FIG. 10*a* an amount of play additional to that applicable to FIG. 10 has been provided in the ejector 11 or in its transmission linkage and this allows a spring 27 to come into operation. This spring 27, acting in opposition to the spring 12 (FIG. 1), thus assumes a subdivided ejector 11 at least at the movable die; this, however, is in practice always the case. Since the spring 27 will always attempt to push the ejector 11 into its forward end position it will also still press it against the shaped workpiece 26 for a short time after the movable die 1 has already retracted further. The spring 27 bears, on the one hand, against a collar 28 formed at the ejector 11 and, on the other hand, on an inner shoulder (not shown) of the corresponding drilling in the movable die. Its stroke is only very short, of the order of about 1 mm, and it is in practice, therefore, loaded only statically.

The shaped workpiece 29 in FIG. 11 has a relatively short extension 29*a* on its side adjacent the fixed die. Within the context of the invention another variant offers itself here for the ejection device. As shown by the curve E for the ejector at the movable die, the ejector at the movable die here moves back a little (distance e) with the press slide after the FDC (position I) which is achieved by play between the roller arm 8 (FIG. 1) and the ejector 11. The motion curve of the front edge of the roller arm facing the ejector 11, referenced Eh in FIG. 11, runs in a straight line from the FDC and then meets the ejector curve E as soon as the above-mentioned play has been compensated for. The ejector 25 at the fixed die is here controlled in such a way that it pushes out the shaped workpiece after the ejector at the movable die, provided the shaped workpiece is not stuck in the drilling of the movable die, and ejects it from the fixed die (position II in FIG. 11). Now the movable die 1 continues its return stroke while the ejector 11 at the movable die ejects the long extension 29*b* (position III). During the transition from position II to position III the shaped workpiece can be gripped by the gripper Z. Here, too, the ejector 11 of the movable die is biassed elastically by a spring 27 so that its holding function is safeguarded.

I claim:

1. A device for forming a shaped workpiece, comprising fixed die means; movable die means; means mounting said movable die means for movement towards and away from said fixed die means; drive means for said movable die means, said drive means comprising crankshaft means, and connecting rod means connecting said crankshaft means and said movable die means, whereby said movable die means executes a succession of reciprocatory strokes forming operating cycles; ejector means operatively associated with said movable die means; cam means operatively connected to said ejector means for controlling said ejector means for oscillatory movement; cam follower means engaging said cam means and connected to drive said ejector means in response to operation of said cam means, and means drivingly connecting said cam means to said crankshaft means; wherein said cam means has an axis of pivoting and means defining a cam contour which comprises (a) an arc concentric to said axis of pivoting and (b) a straight region joining said arc and following said arc serially in the direction of travel of said cam follower means along said cam contour during actuation of said ejector means in response to said cam follower means; said cam means further comprising first and second cam portions and means releasably connecting said second cam portion to said first cam portion for movement to allow repositioning of said second cam portion to shorten or lengthen said straight region of said cam contour whereby control of said ejector means can be effected so that said ejector means remains stationary relative to said fixed die means for a part of each said operating cycle of the movable die means and ejector means and whereby the duration of said part of each operating cycle is maintained independent of the length of the stroke of travel executed by said movable die means.

2. A device according to claim 1, wherein said straight region of said cam contour is in part arranged on said first cam portion and in part on said second cam portion and extends parallel to the direction of movement of said second cam portion with respect to said first cam portion.

3. A device according to claim 2, wherein said second cam portion has means defining a U-shaped cross-section comprising two spaced parallel limbs, and said first cam portion has means defining a tongue fitting between said limbs of the U formed by said cross-section of the second cam portion; and wherein said cam means further includes: (a) means for moving said second cam portion relative to first cam portion, said moving means comprising: a spindle rotatably carried by said first cam portion, and means constraining said spindle against axial displacement relative to said first cam portion; and (b) fixing screw means carried by said first cam portion for locking said second cam portion in any desired position.

4. A device for forming a shaped workpiece, comprising fixed die means; movable die means; means mounting said movable die means for movement towards and away from said fixed die means, drive means for said movable die means, said drive means comprising crankshaft means, and connecting rod means connecting said crankshaft means and said movable die means, whereby said movable die means executes a succession of reciprocatory strokes forming operating cycles; ejector means operatively associated with said movable die means; cam means operatively connected to said ejector means for controlling said ejector means for oscillatory movement; cam follower means engaging said cam means and connected to drive said ejector means in response to operation of said cam means; and means drivingly connecting said cam means to said crankshaft means; wherein said cam means has an axis of pivoting and means defining a cam contour which comprises (a)

means defining an arc concentric to said axis of pivoting, and (b) a straight region joining said arc and following said arc serially in the direction of travel of said cam follower means along said cam contour during actuation of said ejector means in response to said cam follower means; said cam means further comprising a first cam portion, a plurality of alternative second cam portions each adapted to be used alone in conjunction with said first cam portion, and means releasably connecting any one of said alternative second cam portions to said first cam portion for selecting a different configuration of said cam contour to shorten or lengthen said straight region whereby control of said ejector means can be effected so that said ejector means remains stationary relative to said fixed die means for a part of each said operating cycle of the movable die means and ejector means, and whereby the duration of said part of the cycle is maintained independent of the length of the stroke of travel executed by said movable die means.

5. A device according to claim 4, wherein said alternative second cam portions each includes respective said means defining straight regions of said cam contour, and means defining transition regions whereby each said transition region smoothly joints said straight region of said second cam portion and said concentric arc, said straight regions being arranged such that for each of said alternative second cam portions the straight region is at a different spacing from said pivot axis of said cam means, and said straight regions being positioned such that they each allow the travel of said ejector means to be kept independent of the choice of said alternative second cam portions to be connected to said first cam portion, whereby the length of the respective straight region is inversely proportional to the distance of said straight region from said pivot axis.

6. A device according to claim 4, wherein said straight regions of said alternative second cam portions are equally spaced from said pivot axis and the straight regions of said alternative second cam portions are of differing length.

7. A device according to any one of claims 1 to 6 and including rotatable shaft means carrying said cam means, said cam means being rotatable relative to said shaft means into one of several different angular positions thereon, and means for locking said cam means on said rotatable shaft means in one of the several different angular positions.

8. A device according to any one of claims 1 to 6, wherein said fixed die means comprise a plurality of fixed dies, and said movable die means comprise a plurality of movable dies each associated with a respective one of said fixed dies, and said ejector means comprise a plurality of ejectors each associated with a respective one of said movable dies.

* * * * *

UNITED STATES PATENT OFFICE

CERTIFICATE OF CORRECTION

Patent No. 4,250,730 Dated Feb. 17, 1981

Inventor(s) Hans Richner

It is certified that error appears in the above-identified patent and that said Letters Patent are hereby corrected as shown below:

In the heading of the Patent [30] should read as follows:

[30] Foreign Application Priority Data

March 23, 1978 W. Germany..... 28 12 695

Signed and Sealed this

*Eighth* Day of *September 1981*

[SEAL]

*Attest:*

GERALD J. MOSSINGHOFF

*Attesting Officer* *Commissioner of Patents and Trademarks*